US008154469B2

(12) United States Patent
McKinley et al.

(10) Patent No.: US 8,154,469 B2
(45) **Date of Patent: *Apr. 10, 2012**

(54) RADIO FREQUENCY (RF) TRANSITION DESIGN FOR A PHASED ARRAY ANTENNA SYSTEM UTILIZING A BEAM FORMING NETWORK

(75) Inventors: Chris D. McKinley, Seattle, WA (US); Ming Chen, Bellevue, WA (US); John B. O'Connell, Seattle, WA (US)

(73) Assignee: The Boeing Company, Chicago, IL (US)

( * ) Notice: Subject to any disclaimer, the term of this patent is extended or adjusted under 35 U.S.C. 154(b) by 542 days.

This patent is subject to a terminal disclaimer.

(21) Appl. No.: 11/767,170

(22) Filed: Jun. 22, 2007

(65) Prior Publication Data

US 2008/0316097 A1 Dec. 25, 2008

(51) Int. Cl.
*H01Q 1/50* (2006.01)

(52) U.S. Cl. ..... 343/850; 343/700 MS; 343/702; 343/905; 343/906

(58) Field of Classification Search ..... None
See application file for complete search history.

(56) References Cited

U.S. PATENT DOCUMENTS

| | | | | |
|---|---|---|---|---|
| 5,619,829 | A * | 4/1997 | Tan et al. | 52/293.3 |
| 5,886,671 | A | 3/1999 | Riemer et al. | |
| 5,907,304 | A | 5/1999 | Wilson et al. | |
| 6,642,908 | B2 | 11/2003 | Pleva et al. | |
| 7,187,342 | B2 * | 3/2007 | Heisen et al. | 343/853 |
| 7,342,801 | B2 * | 3/2008 | Jandzio et al. | 361/760 |
| 7,609,210 | B2 * | 10/2009 | Chen et al. | 343/700 MS |
| 2003/0095066 | A1 | 5/2003 | Brogden | |
| 2003/0137031 | A1 | 7/2003 | Young et al. | |
| 2004/0150554 | A1 | 8/2004 | Stenger et al. | |
| 2006/0270279 | A1 * | 11/2006 | Heisen et al. | 439/637 |
| 2009/0135085 | A1 * | 5/2009 | Raby et al. | 343/906 |

FOREIGN PATENT DOCUMENTS

| | | | |
|---|---|---|---|
| CN | 201108893 | * | 9/2008 |
| CN | 201204331 | * | 3/2009 |
| GB | 865474 | | 4/1961 |
| GB | 2426876 | | 6/2006 |

(Continued)

OTHER PUBLICATIONS

David Lynch, Jr., "Introduction to RF Stealth," Scitech Publishing Company, Raleigh, NC, (2004), 5 pages.

(Continued)

*Primary Examiner* — Trinh Dinh
(74) *Attorney, Agent, or Firm* — Caven & Aghevli LLC

(57) ABSTRACT

In accordance with an embodiment, a radio frequency transition system includes a stripline trace section with openings in ground planes and forms a quarter wavelength resonator and an electromagnetic mechanism to couple the RF energy from the stripline trace section to a connector, wherein the RF signal energy is transferred from inside a beam forming network printed wiring board to an a back side of a phased array antenna system with minimal RF losses. An RF transition system is disclosed. The RF transition system comprises a stripline trace section with openings in ground planes and forms a quarter-wavelength resonator. The RF transition system further includes an electromagnetic mechanism to couple the RF energy from the stripline trace section to a connector. The RF signal energy is transferred from inside a beam forming network printed wiring board to an a back side of a phased array antenna system with minimal RF losses.

9 Claims, 15 Drawing Sheets

FOREIGN PATENT DOCUMENTS

| | | | |
|---|---|---|---|
| WO | WO 01/18901 | | 3/2001 |
| WO | WO 03/049231 | | 6/2003 |
| WO | WO 2004/051805 | * | 4/2004 |
| WO | WO 2004/051805 | | 6/2004 |

OTHER PUBLICATIONS

European Search Report, European Patent Office, Jan. 13, 2009.
European Search Report, European Patent Office, Oct. 23, 2008.

* cited by examiner

RADIO FREQUENCY (RF) TRANSITION DESIGN FOR A PHASED ARRAY ANTENNA SYSTEM UTILIZING A BEAM FORMING NETWORK

CROSS-REFERENCE TO RELATED APPLICATIONS

This application is related to co-pending patent application filed concurrently on even-date herewith, entitled, "A Phased Array Antenna System Utilizing A Beam Forming Network" as Ser. No. 11/767,129, all of which is incorporated herein by reference.

FIELD OF THE INVENTION

The present embodiments relate generally to beam forming networks and more particularly to phased array antennas utilizing such networks.

BACKGROUND

Active phased array antenna systems are capable of forming one or more antenna beams of electromagnetic energy and electronically steering the beams to targets, with no mechanical moving parts involved. A phased array antenna system has many advantages over other types of mechanical antennas, such as dishes, in terms of beam steering agility and speed, low profiles, low observability, and low maintenance.

A beam forming network is a major and critical part of a phased array antenna system. The beam forming network is responsible for collecting all the electromagnetic signals from the array antenna modules and combining them in a phase coherent way for the optimum antenna performance. The element spacing in a phased array is typically at one-half of the wavelength for electromagnetic waves in space.

There are design challenges when utilizing a phased array antenna system. Firstly, it is important that the phased array include a rhombic shape of aperture for low observability requirements of the system. In addition, the system should be as small as possible to conserve space while still having the same performance characteristics of conventional shaped phased array antenna systems. Furthermore, as array antenna frequency increases, the element spacing decreases in an inversely proportional manner. Due to this tight spacing in phased arrays at microwave frequencies, transitions of radio frequency (RF) energy from inside of the beam forming network printed wiring board to the backside of the antenna have always been one of the critical RF design factors in phased array development. Conventional designs had tighter tolerances in the feature alignments of the RF transition, which limits the choice of suppliers for the systems and impacts the cost and schedule for producing the antennas as well.

What is needed is a method and system to overcome the above-identified issues. One or more of the present embodiments address one or more of the above-identified needs and others.

The features, functions, and advantages can be achieved independently in various embodiments of the present invention or may be combined in yet other embodiments.

SUMMARY OF THE INVENTION

Embodiments of an RF transition system are disclosed. According to one or more embodiments, the RF transition system comprises a stripline trace section with openings in ground planes, forming a quarter-wavelength resonator. The RF transition system further includes an electromagnetic mechanism to couple the RF energy from the stripline trace section to a connector. The RF signal energy is transferred from inside a beam forming network printed wiring board to an antenna back plane with minimal RF losses.

According to an embodiment, an RF transition module includes a first port, a can coupled above the first port, the can including dielectric material therein, wherein the can tunes the transition module by varying the properties of the dielectric material, a connector coupled to the first port and a second port coupled to the connector, wherein the transition modules provide RF signals to a phased array antenna system.

According to another embodiment, a phased array antenna system includes a printed wiring board formed in rhombic shape that accommodates requirements for low observability, a beam forming network located within the printed wiring board, wherein the beam forming network is located over substantially the entire printed wiring board, an RF transition system comprising a stripline trace section with openings in ground planes and forms a quarter wavelength resonator and an electromagnetic mechanism to couple the RF energy from the stripline trace section to a connector, wherein the RF signal energy is transferred from inside the printed wiring board to a back side of a phased array antenna system with minimal RF losses and connectors located on the backside of the printed wiring board that allows for expansion of the system.

According to yet another embodiment, a method for transferring RF signal energy includes forming a quarter wavelength resonator, coupling the RF signal energy from a stripline trace section to a connector, wherein the RF signal energy is transferred from inside a beam forming network printed wiring board to an a back side of a phased array antenna system with minimal RF losses.

DETAILED DESCRIPTION

The present embodiment relates generally to beam forming networks and more particularly to phased array antennas utilizing such networks. The following description is presented to enable one of ordinary skill in the art to make and use the embodiment and is provided in the context of a patent application and its requirements. Various modifications to the embodiments and the generic principles and features described herein will be readily apparent to those skilled in the art. Thus, the present embodiment is not intended to be limited to the embodiments shown, but is to be accorded the widest scope consistent with the principles and features described herein.

Figure 1A:
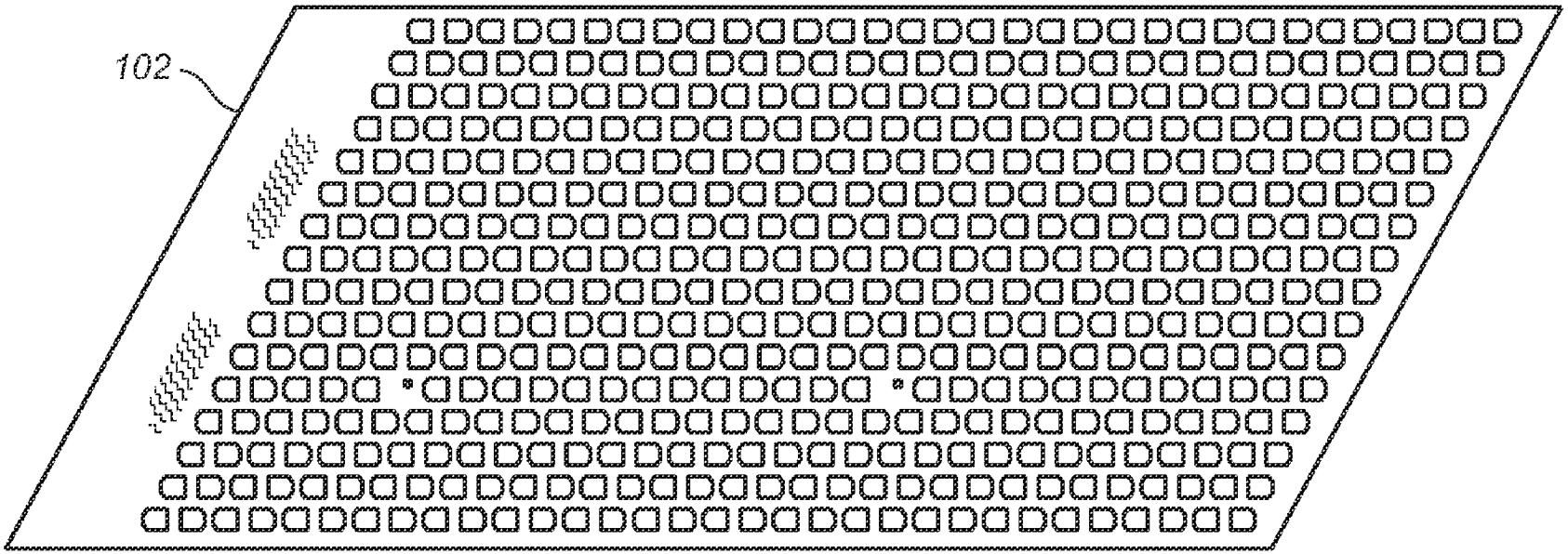
FIG. 1A is a mechanical schematic of one embodiment of a beam forming network within a printed wiring distribution board which has a rhombic shape, according to an embodiment.

Every phased array antenna system includes a beam forming network to coherently combine the signals from all of its many elements. It is this signal combining ability that forms the electromagnetic beam. FIG. 1A shows a beam forming distribution board 10 for a conventional phased array antenna system which has the rectangular shape for the beam forming network. As is known the rectangular shape provides problems because it is easily observable electronically due to its electronic signature. Hence it is desirable for the phased array antenna system to be rhombic in shape to allow for low observability.

Active electronically scanned phased arrays have been produced that contain a large number of phased array elements. For example, The Boeing Company has produced such a phased array antenna system that contains 4,096 elements in 8 subarrays arranged in a 2×4 configuration.

In a conventional receive phased array antenna system all of the DC power and logic interconnections are placed at the outside edges of the subarray. One cannot add more subarray columns to increase the size without having large gaps in-between adjacent subarrays. In conventional phased array antenna systems such as K-band arrays, the rhombic shape of aperture for phased array antennas were accomplished by either using the metal plate itself, (which offered only the minimum benefit to the low observability), or having passive dummy elements placed around the rectangular shape of active elements.

There are four critical features in that distinguish the beam forming network of the present embodiment over conventional beam forming networks:

(1) A rhombic shape of the beam forming network subarray that accommodates requirements for low observability and utilizes beam forming elements over substantially the entire array.

(2) Reduced the column and row gaps in between the subarray panels, with improved results on the antenna beam patterns.

(3) Improved RF bandwidth and mechanical tolerances in the RF transition from the beam forming network to the backside of the array.

(4) Back side interconnections that allow the array architecture to expand to include more subarrays and thus more elements in a full size array.

A phased array antenna system in accordance with an embodiment expands the capabilities of phased array antenna systems in two critical areas: (1) providing a low observability compliant phased array aperture with reduced size, weight and cost; and (2) providing a beam forming network scalability to large full-size arrays. Both capabilities allow for the enhanced phased array antennas utilized for a variety of applications. To describe the features of the phased array antenna system refer now to the following description in conjunction with the accompanying figures.

Figure 1B:
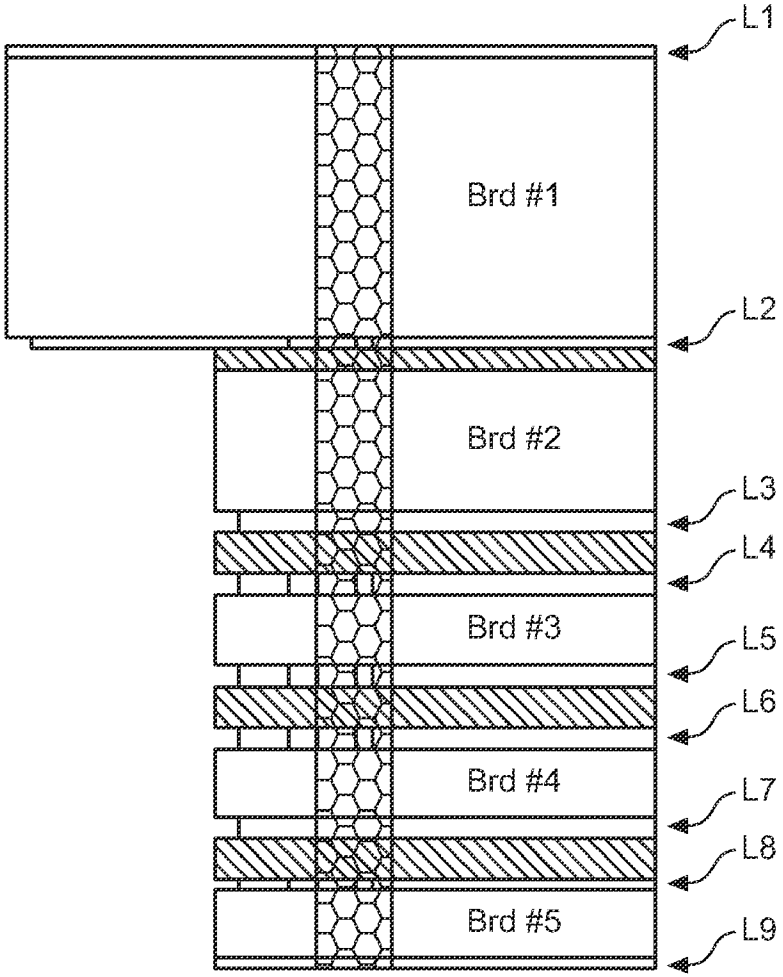
FIG. 1B illustrates the layers associated with the printed wiring board of FIG. 1A.

FIG. 1A is a mechanical schematic of one embodiment of a beam forming network 100 within a printed wiring board 102. The beam forming network 100 is formed inside a rhombic shape printed wiring board (PWB) 102, so that two or more of such identical boards can be put together to form a larger sized array without compromising the low observability characteristics. In this embodiment, the rhombic shape of the aperture is covered with active beam forming elements for a maximum cost effective benefit to the antenna system. In an embodiment, the PWB 102 includes nine layers as shown in FIG. 1B.

Figure 2:
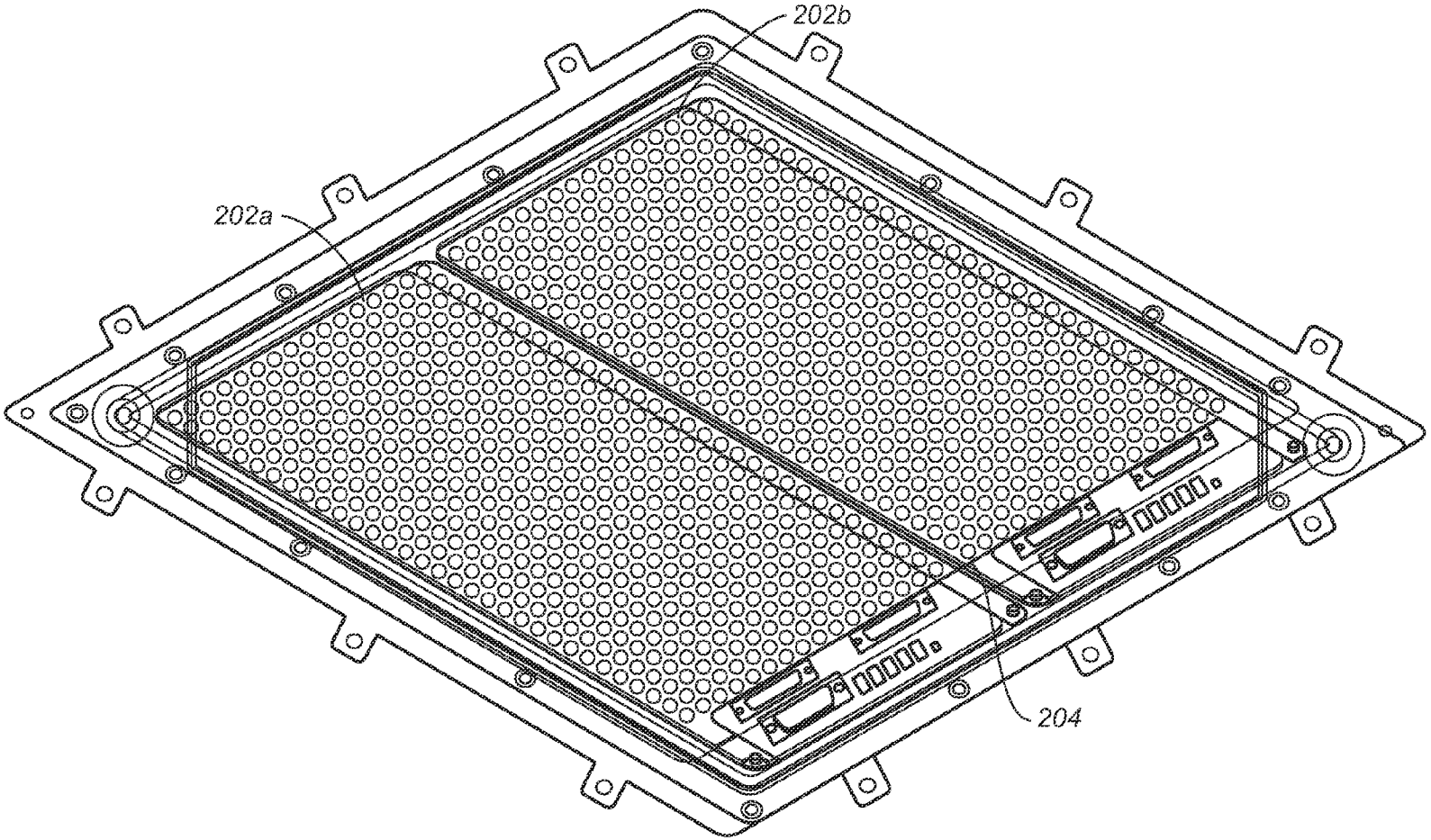
FIG. 2 is a mechanical schematic of the receive phased array antenna system with two subarrays of the beam forming network as shown in FIG. 1A.

FIG. 2 is a mechanical schematic of the receive phased array antenna system 200 with two subarrays 202*a* and 202*b* of the beam forming network, according to an embodiment. One critical feature is the narrowing of the non-active-element gaps around each board when two or more identical PWBs are put together to form large arrays. FIG. 2 shows that the edge gaps 204 in-between the adjacent boards are of only one element spacing, as compared with two element spacing in the conventional phased arrays. This reduction in the gap width improves the antenna beam patterns. The reduction of gap width is accomplished by laying out the beam forming circuits of the subarrays 202*a* and 202*b* in a more efficient manner. Also, by placing all of the circuitry and connectors on the backside of adjacent subarrays, the subarrays can be placed closer together than the subarrays utilized in a conventional phased array antenna system.

Figure 3A:
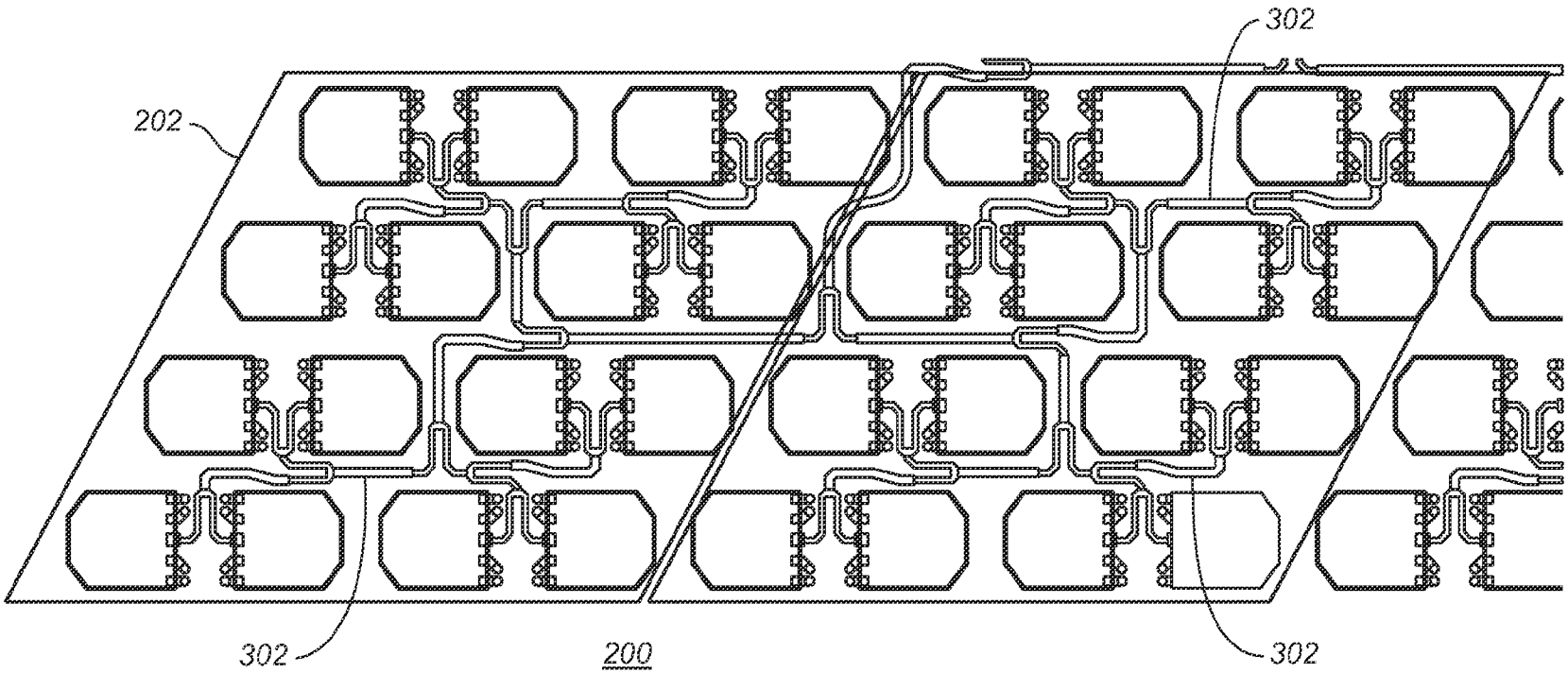
FIG. 3A is a diagram view of the beam forming network RF circuits inside the beam former printed wiring board, according to an embodiment.
Figure 3B:
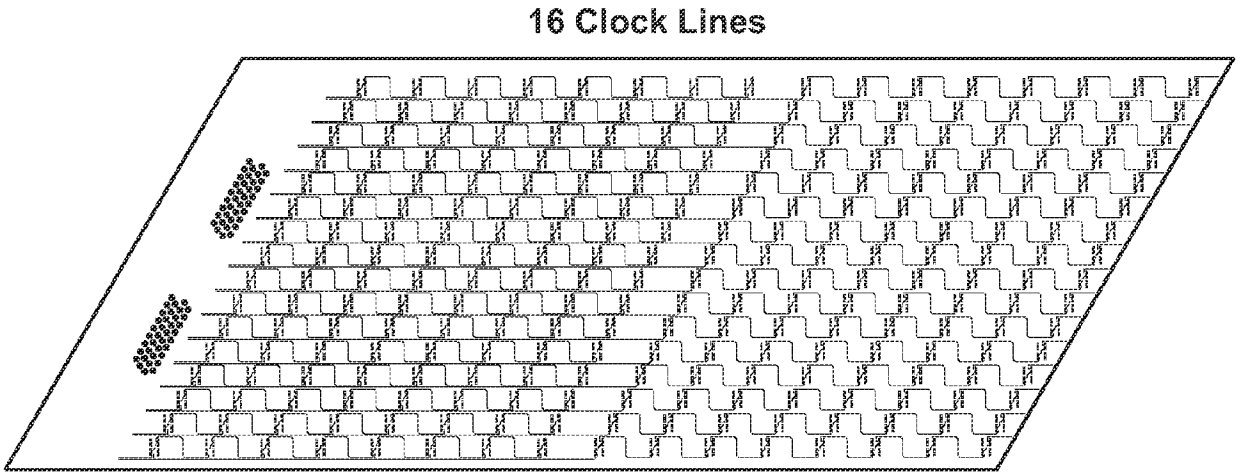
FIG. 3B shows the octagonal arrangement of clock lines and data lines on the beam former printed wiring board, according to an embodiment.
Figure 3C:
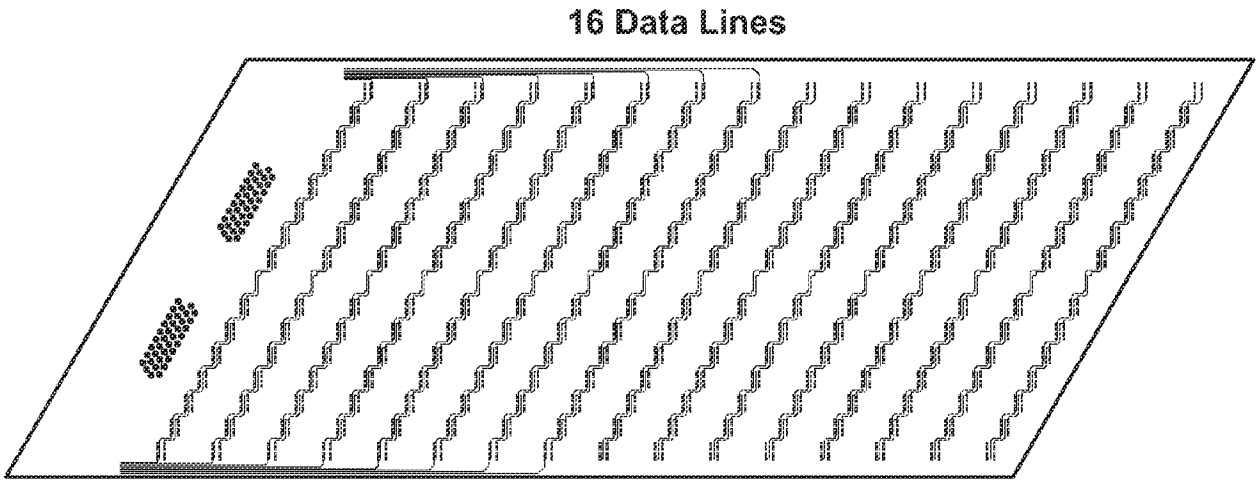
FIG. 3C shows the octagonal arrangement of data lines on the beam former printed wiring board, according to an embodiment.

FIG. 3A is a diagram of a portion of the beam forming network circuits 200 inside the PWB 202. FIG. 3A shows stripline traces 302 on the RF layer (not shown) embedded inside the printed wiring board 202. These stripline traces 302 form the RF distribution network for the beam forming function. As is seen in FIGS. 3B and 3C, the data and clock lines are arranged in an orthogonal style to provide a more efficient layout on the PWB 202 and more robust signal integrity for array's beam steering control.

Figure 4:
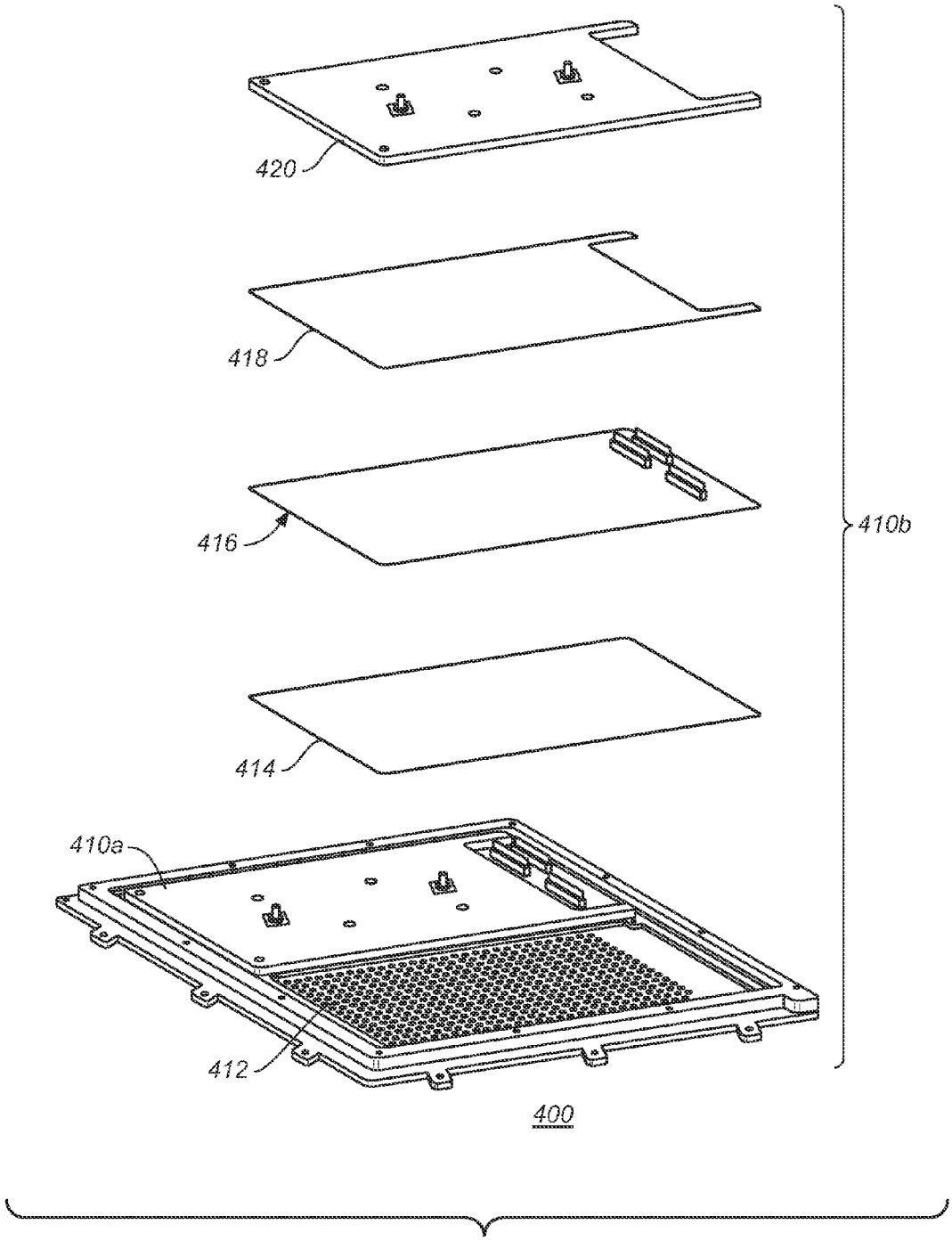
FIG. 4 is a diagram of a receive phased array antenna assembly, according to an embodiment.
Figure 5:
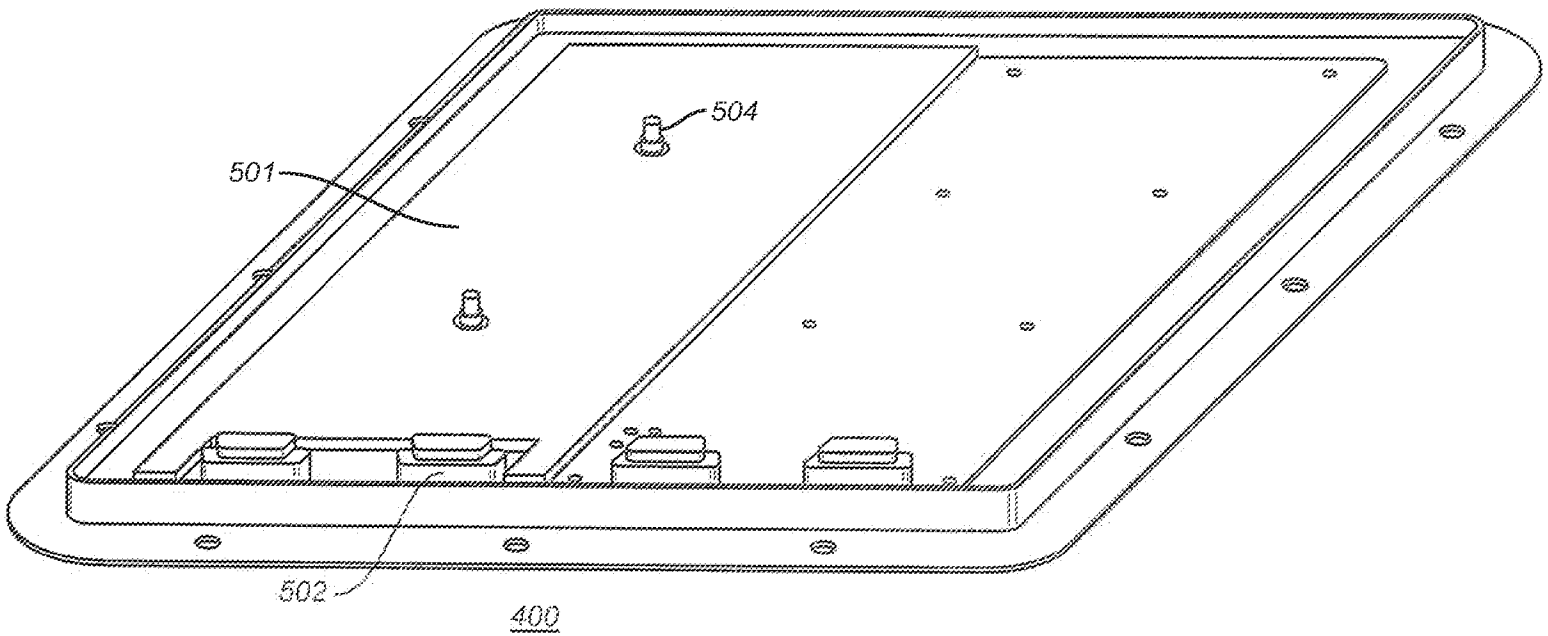
FIG. 5 illustrates the back side of the phased array antenna system that shows the back side connectors for direct-current (DC) power and logic, and the coaxial connectors for the RF signals, according to an embodiment.

The array assembly and the backside interconnections for the phased array antenna system are shown in FIG. 4 and FIG. 5. FIG. 4 is a diagram of a receive phased array antenna assembly 400. In this embodiment one subarray 410*a* is shown assembled and one subarray 410*b* is shown in exploded view. As is seen the subarray 410*b* includes a plurality of subarray elements 412, a module shim 414, a multilayer wiring board (MLWB) 416, an elastomer connector shim 418 and a pressure plate with thermal transfer material 420. The MWLB is utilized advantageously to provide the RF, power and logic distribution for the phased array antenna. These elements are coupled together as shown in subarray 410*a* to provide the rhombic shaped array.

FIG. 5 illustrates the back side of the phased array antenna system showing the back side connectors for DC/logic connector 502, and the RF port coaxial connector 504 for the RF signals. By including these connectors on the back side of the board the subarrays can be placed closer together. The RF port connector provides for an RF transition for the beam forming network printed wiring board and the array housing. As before mentioned, in conventional subarrays, the connectors are placed on the sides of the PWB thereby causing adjacent subarrays to be placed at a distance from each other based upon the size of the connectors. In one embodiment there is one port per each subarray. A phased array antenna system in accordance with an embodiment expands the capabilities of phased array antenna systems in two critical areas: (1) providing a low observability compliant phased array aperture with reduced size, weight and cost; and (2) providing a beam forming network scalability to large full size arrays. Both capabilities allow for the enhanced phased array antennas utilized for a variety of applications. The embodiment includes a RF transition module that two key improvements over the previous RF transition modules:

(1) improved RF bandwidth with more tuning range by selecting the optimum material dielectric constant for the tuning block.

(2) more relaxed mechanical tolerances in the RF transition from the beam forming network to the backside of the array, thus making the board more manufacturable, with lower cost. To describe the features of the RF transition module in more detail refer now to the following description in conjunction with the accompanying figures.

The RF distribution network constructed inside the PWB for the beam forming function is shown in FIG. 3A. The RF traces are connected at each 256-element level to the transition module 600 shown above in FIG. 6.

Figure 6:
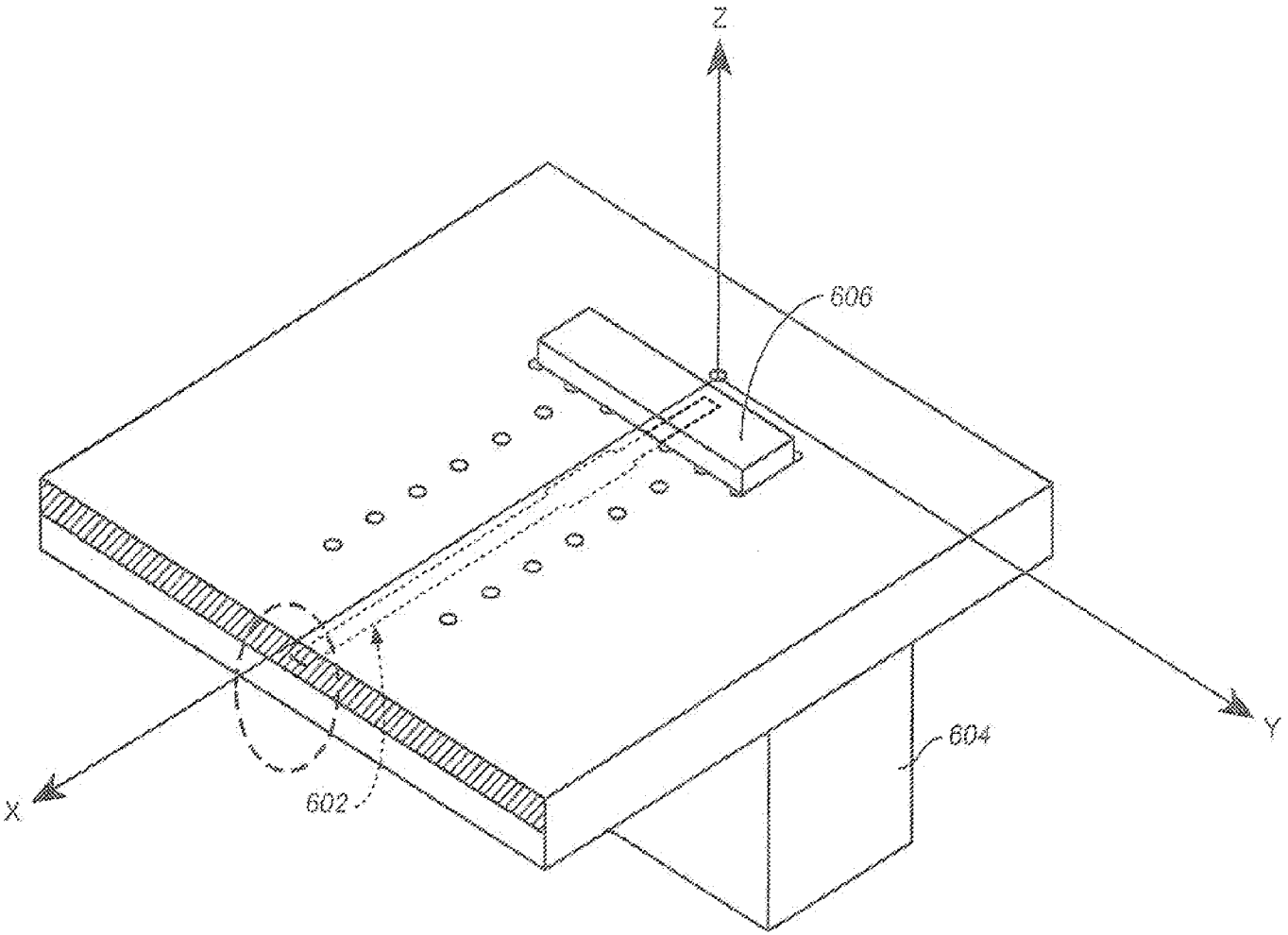
FIG. 6 is a perspective view of a stripline to waveguide transition module, according to an embodiment.
Figure 7A:
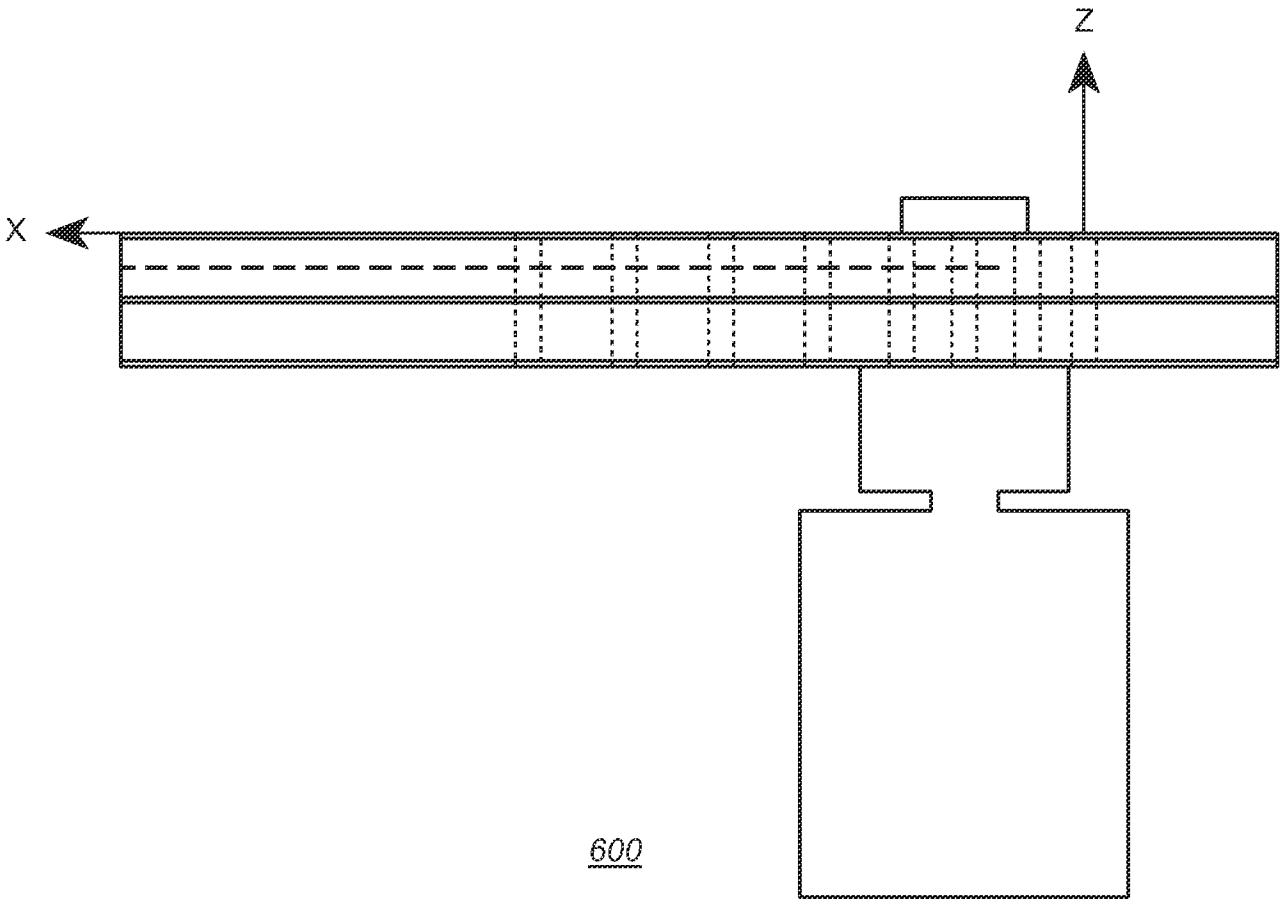
FIG. 7A shows a side view of an RF transition module, according to an embodiment.
Figure 7B:
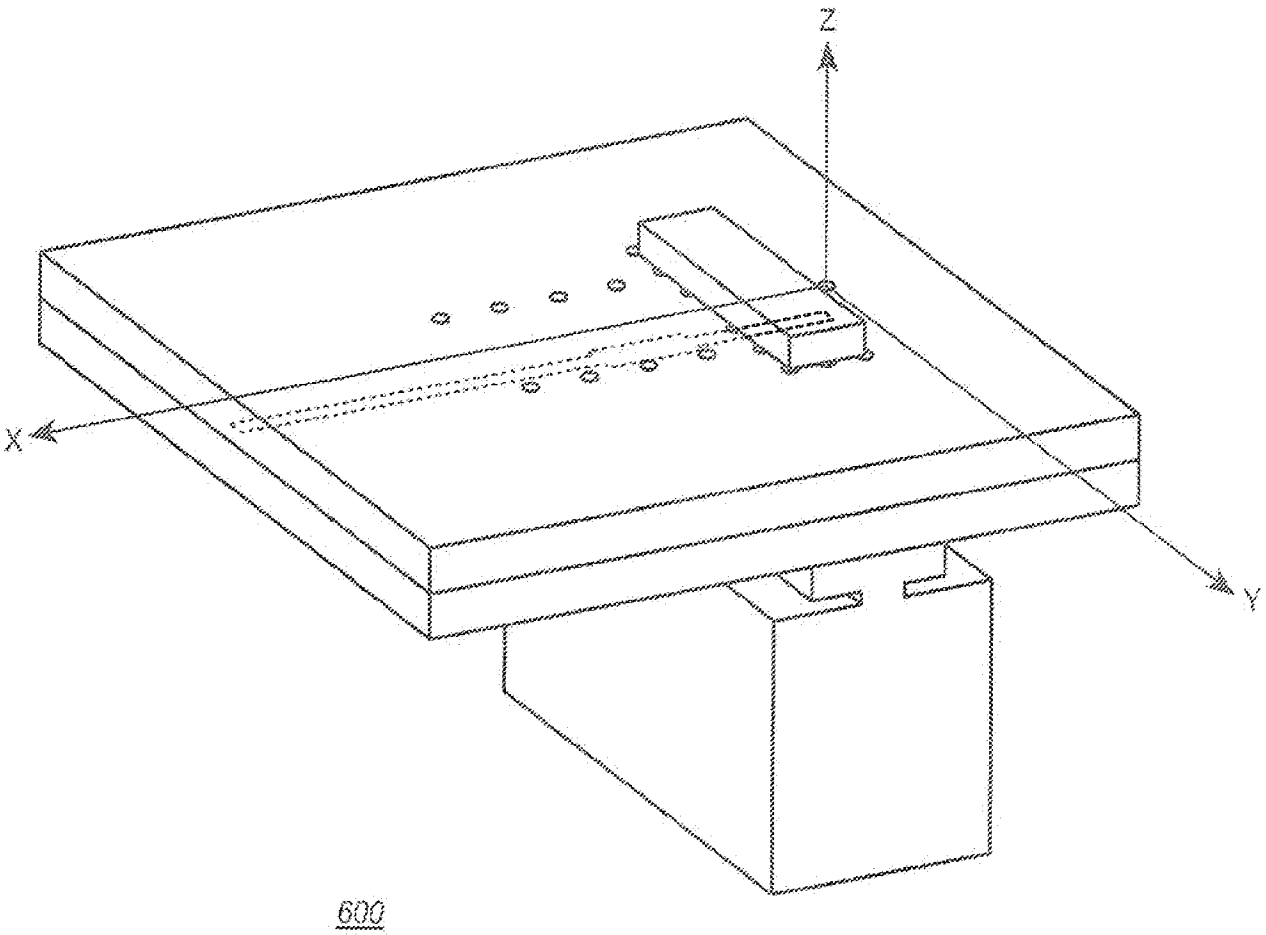
FIG. 7B shows an isometric view of the RF transition module, according to an embodiment.
Figure 7C:
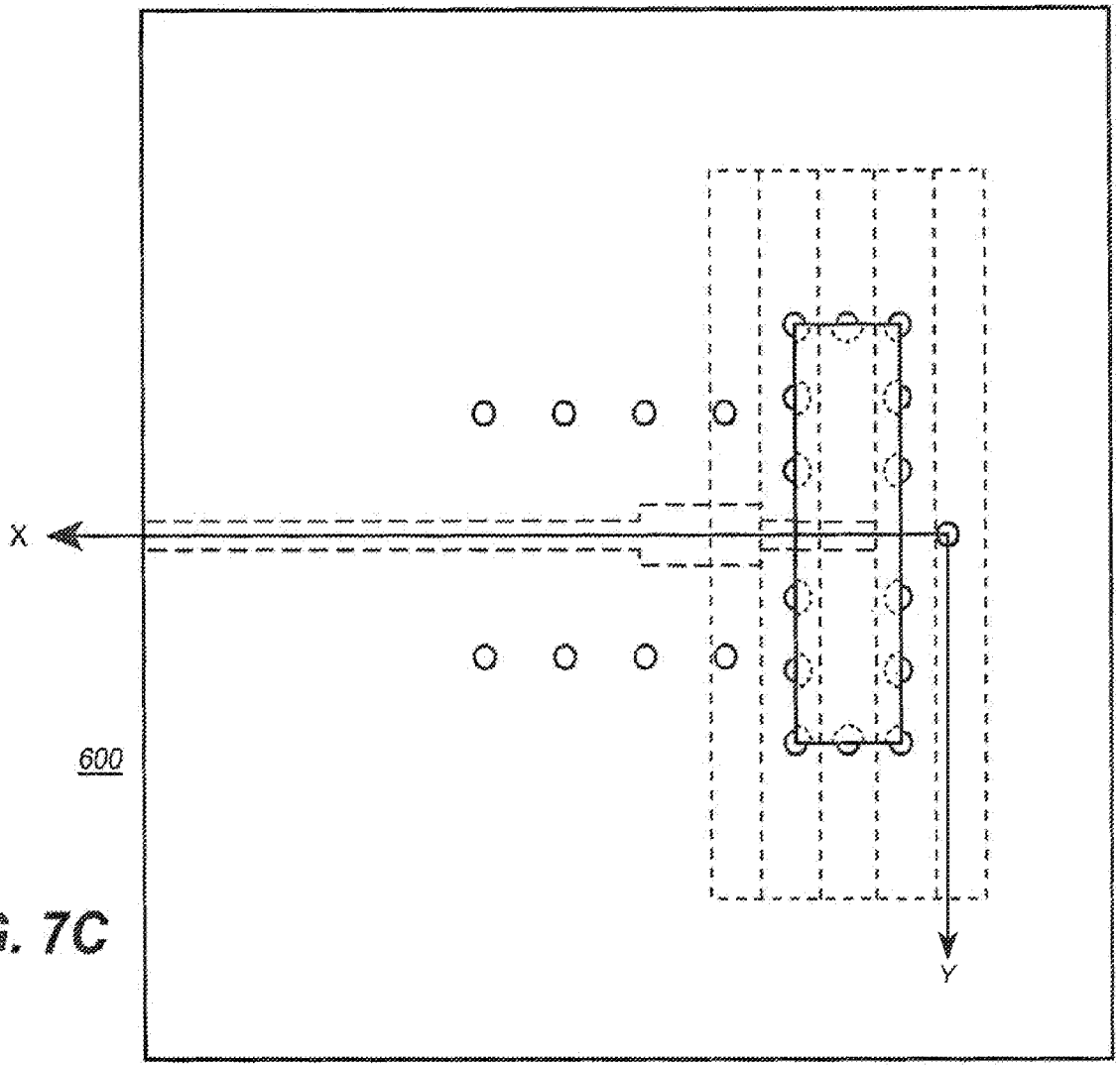
FIG. 7C shows a plan view of the RF transition module.
Figure 7D:
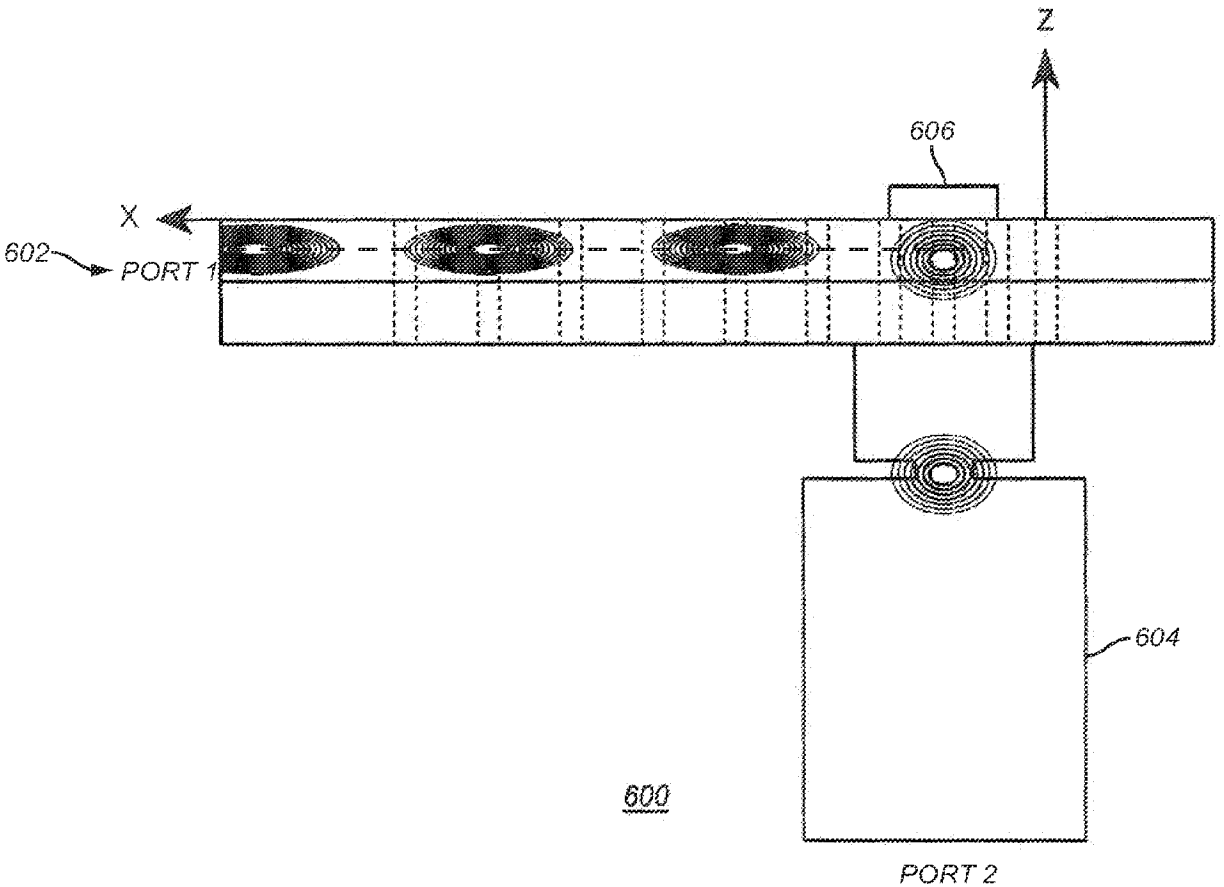
FIG. 7D shows an electromagnetic field distribution inside the RF transition module.

FIG. 6 is a perspective view of a stripline to waveguide RF transition module 600 in accordance with one or more embodiments. FIG. 7A shows a side view of the RF transition module 600. FIG. 7B shows an isometric view of the RF transition module 600. FIG. 7C shows a plan view of the RF transition module 600. FIG. 7D shows an electromagnetic field distribution inside the RF transition module 600. As is seen, the RF energy comes in along the stripline 602 (Port 1) and is coupled into the rectangular waveguide 604 (Port 2). The rectangular block 606 placed above the trace represents the dielectric material that is inserted in a can (not shown). The dielectric material 606 tunes the transition coupling performance by varying the material dielectric properties. In one embodiment, the RF transition module comprises a stripline trace section with openings in the nearby ground planes forming a quarter-wavelength resonator. The RF energy from the stripline is electromagnetically coupled to either a rectangular wavelength piece or a coaxial contact.

This RF transition module 600 is integrated in the beam-forming-network-printed-wiring-board. The rhombic shape beam forming network printed wiring board is shown in FIG. 1A. Inside each PWB, two RF transition modules are integrated with the phased array. The transition modules are responsible for combining the elements in one subarray. In one embodiment the subarray includes 256 elements.

Figure 8:
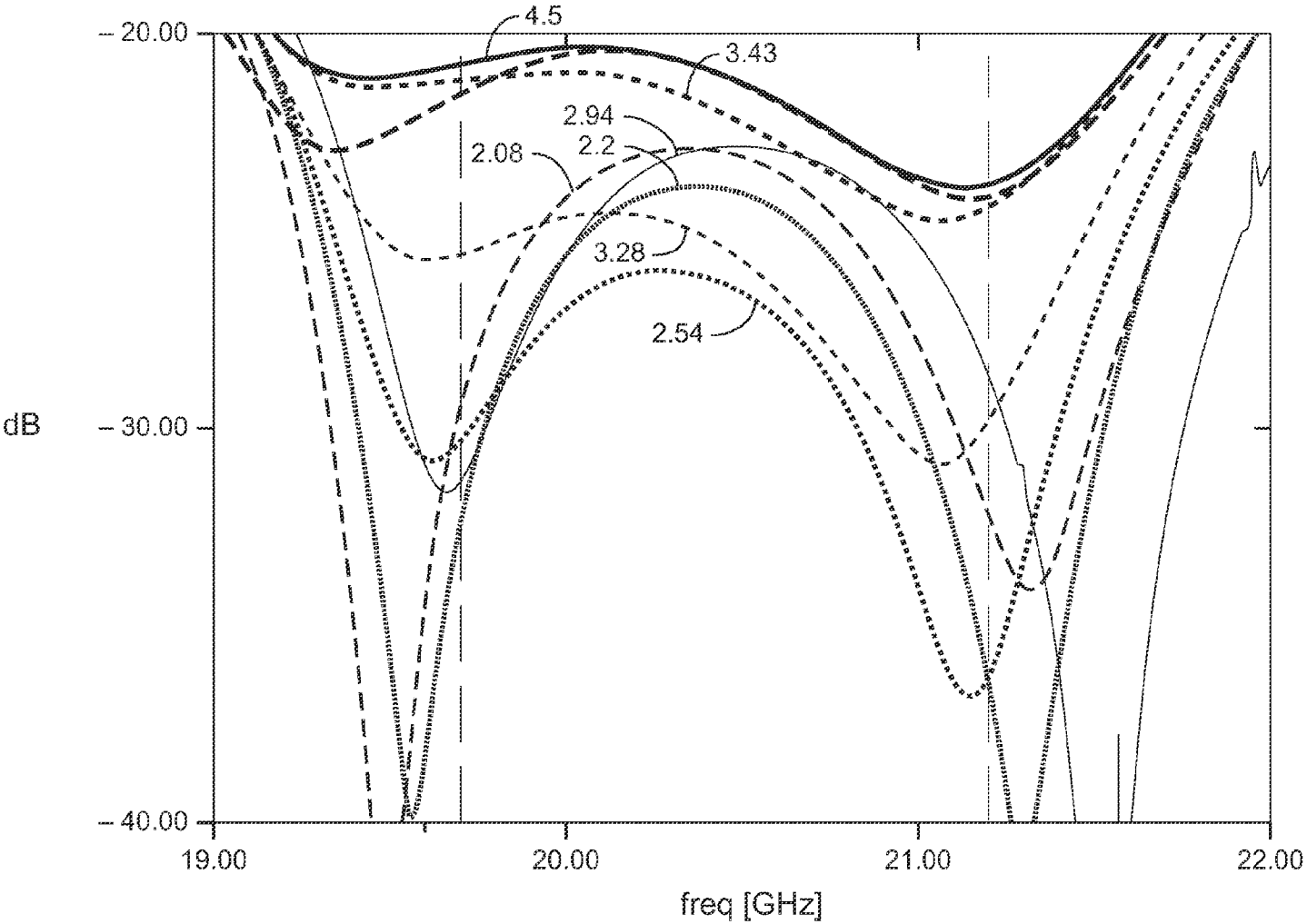
FIG. 8 represents the results of a finite-element electromagnetic field simulation within the waveguide transition module shown in FIG. 6.

FIG. 8 represents the results of a finite-element electromagnetic field simulation within the RF waveguide transition structure shown in FIG. 6. The insert material simulated includes Teflon, Taconic, Rexolite, Rogers Duroid, and Arlon Coefficient of Linear Thermal Expansion (CLTE). The insert material is simulated by varying its dielectric constant and the return losses for the RF transition are plotted as a function of the RF frequency. All materials within the numerical analysis result in a "double null" pattern across the frequency band of interest—this is a desirable characteristic because it means less reflection, better impedance matching, and wider bandwidth in the desired frequency range. FIG. 8 indicates that a return loss of 20 dB or better has been achieved over more than 2 GHz frequency range—better than 10% bandwidth at K-band (20 GHz). This is a significant improvement in operation bandwidth from previous designs.

Figure 9A:
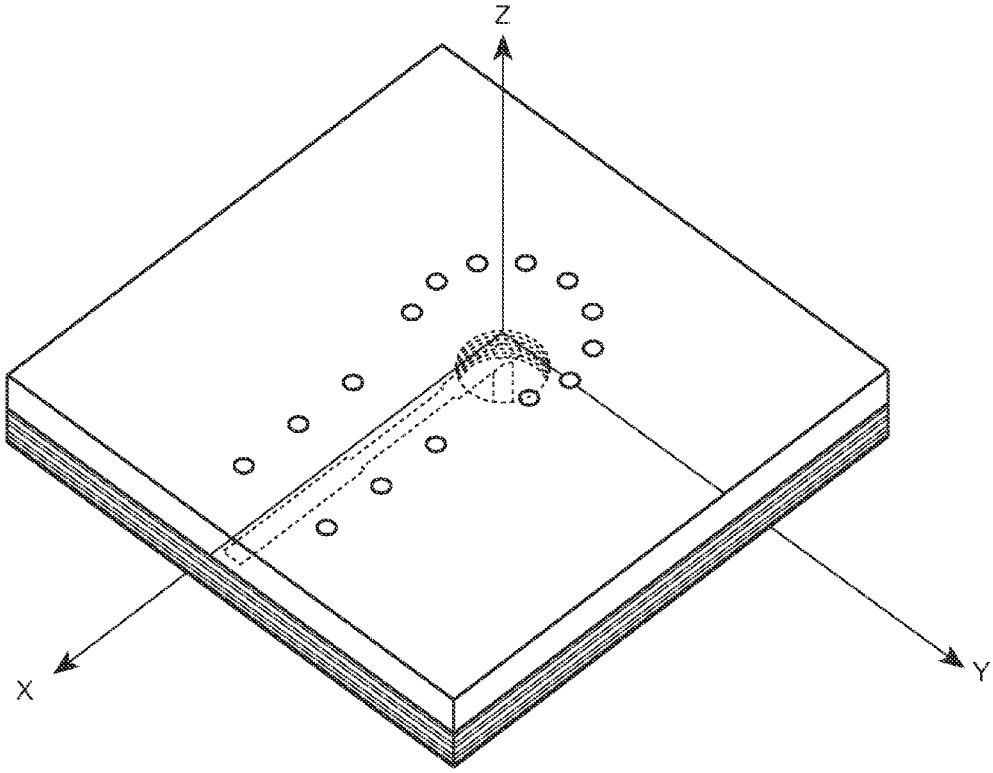
FIG. 9A shows a perspective view of a stripline to coaxial module which also includes a coaxial interface.
Figure 9B:
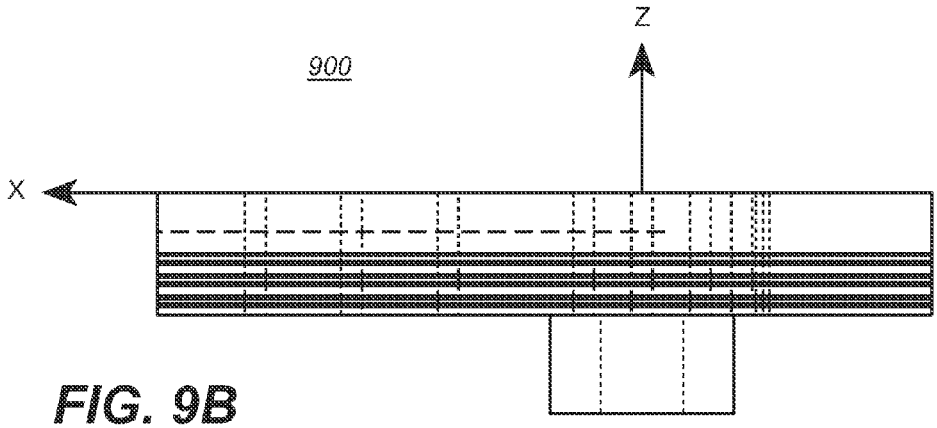
FIG. 9B shows a side view of the stripline to coaxial module which includes a coaxial interface.
Figure 9C:
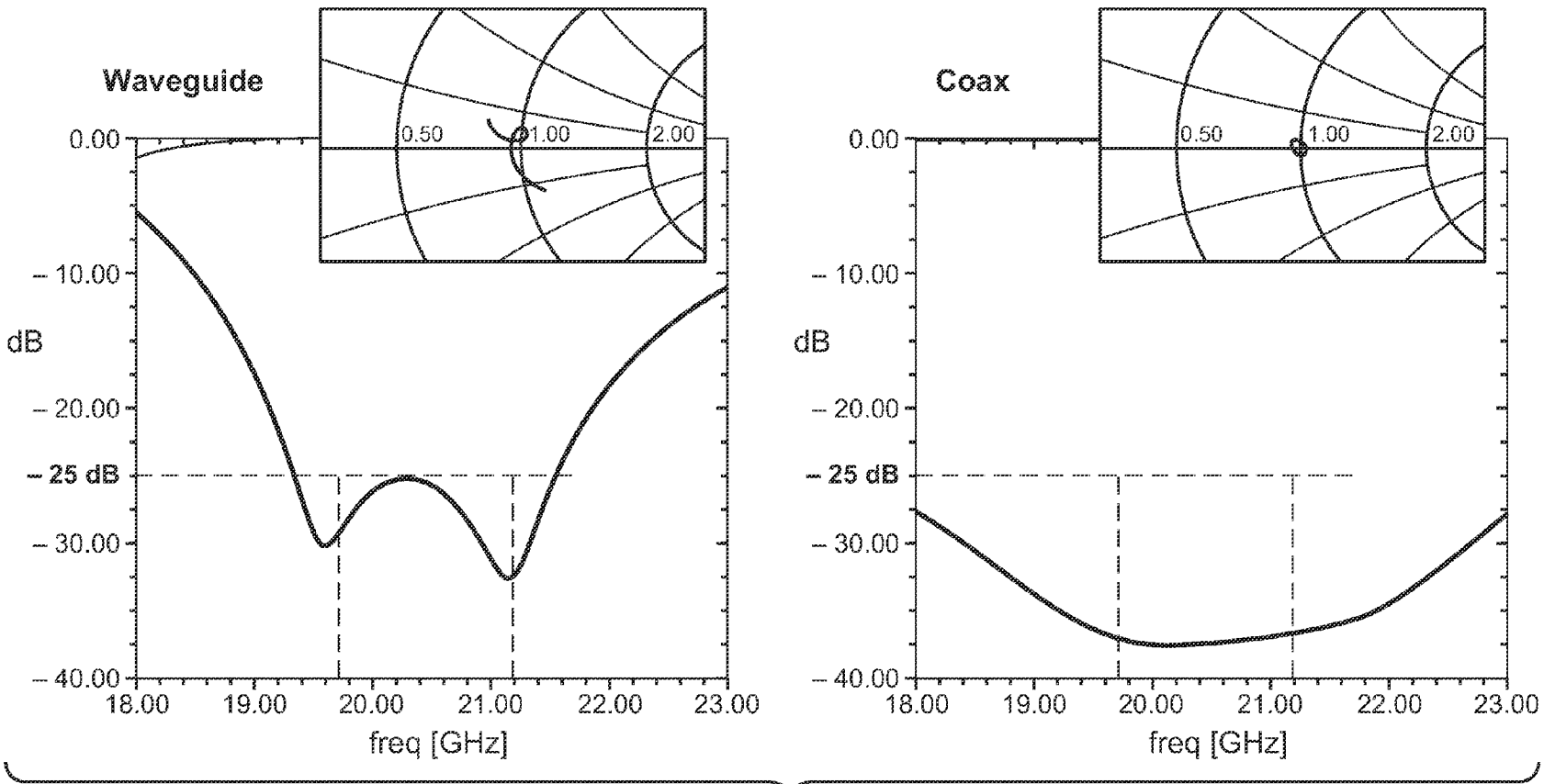
FIG. 9C shows the performance comparison of the stripline to waveguide module and the stripline to coaxial module.

Another RF transition design comprising a low cost commercial off-the-shelf (COTS), surface mount coaxial connector has also been used for the same stripline matching network, i.e., the coaxial matching has been successfully simulated and compared. The waveguide transition module occupies four times the width, but about the same length and height as the coaxial transition module. FIG. 9A shows a perspective view and side view of a stripline to coaxial module 900 which also includes a coaxial interface. FIG. 9B shows the performance of the stripline to waveguide module and the stripline to coaxial connector transition module As is seen, desirable characteristics of these transition modules display wide bandwidth while having a below −25 dB return loss. The waveguide transition module is less sensitive to trace width/length variance, representing manufacturing tolerance fluctuation. Overall, the above-identified modules are simpler structures and less costly than conventional transition modules. Also, the new coaxial transition module is easier to manufacture thereby reducing the cost and the schedule risk associated with manufacturing of the beam forming network.

A phased array antenna system in accordance with an embodiment expands the capabilities of phased array antenna systems in two critical areas: (1) providing a low observability compliant phased array aperture with reduced size, weight and cost; and (2) providing a beam forming network scalability to large full size arrays. Both capabilities allow for the enhanced phased array antennas utilized for a variety of applications.

Although the present invention has been described in accordance with particular embodiments, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. An RF transition system comprising:

a stripline trace section with openings in ground planes, and which forms a quarter wavelength resonator; and wherein the stripline trace section generates an electromagnetic field distribution which couples RF signal energy from the quarter wavelength resonator of the stripline trace section and which forms a connection to transfer RF signal energy from a beam forming network printed wiring board coupled to the stripline trace section to a back side of a phased array antenna system; and a block of dielectric material positioned above a portion of the stripline trace section, wherein the block of dielectric material tunes the performance of the transition system according to the dielectric properties of the block of dielectric material.

2. The RF transition system of claim 1 further comprising a rectangular waveguide.

3. The RF transition system of claim 1 further comprising a coaxial contact.

4. The RF transition system of claim 1 wherein the dielectric material is selected from a group consisting of Teflon, Taconic, Rexolite, Rogers Duroid and Arlon CLT.

5. The RF transition system of claim 1 wherein the dielectric material is selected to provide impedance matching and wide bandwidth in a desired frequency range.

6. A phased array antenna system comprising:

a printed wiring board formed in rhombic shape;

a beam forming network located within the printed wiring board, wherein the beam forming network is located over substantially the entire printed wiring board;

an RF transition system comprising a stripline trace section with openings in ground planes and which forms a quarter wavelength resonator;

wherein the stripline trace section generates an electromagnetic field distribution which couples RF signal energy from the quarter wavelength resonator of the stripline trace section to a coaxial connector, wherein the RF signal energy is transferred from inside the printed wiring board to a back side of the phased array antenna system;

a block of dielectric material positioned above a portion of the stripline trace section, wherein the block of dielectric material tunes the performance of the transition system according to the dielectric properties of the block of dielectric material; and connectors located on the backside of the printed wiring board that allows for expansion of the system.

7. The phased array antenna system of claim 6 wherein the backside connectors comprise a rectangular waveguide.

8. The phased array antenna system of claim 6 wherein the coaxial connector comprises a coaxial contact.

9. The phased array antenna system of claim 6 wherein the dielectric material is selected from a group consisting of Teflon, Taconic, Rexolite, Rogers Duroid and Arlon CLT.

* * * * *